US011713170B2

(12) United States Patent
Mélan-Moutet

(10) Patent No.: US 11,713,170 B2
(45) Date of Patent: Aug. 1, 2023

(54) SCREW CAP INTENDED TO REMAIN ATTACHED TO A CONTAINER AFTER OPENING THE CONTAINER

(71) Applicant: SOCIETE LORRAINE DE CAPSULES METALLIQUES—MANUFACTURE DE BOUCHAGE, Contrexéville (FR)

(72) Inventor: Mathias Mélan-Moutet, Reims (FR)

(73) Assignee: SOCIETE LORRAINE DE CAPSULES METALLIQUES—MANUFACTURE DE BOUCHAGE, Contrexéville (FR)

( * ) Notice: Subject to any disclaimer, the term of this patent is extended or adjusted under 35 U.S.C. 154(b) by 0 days.

(21) Appl. No.: 16/879,311

(22) Filed: May 20, 2020

(65) Prior Publication Data

US 2020/0369446 A1 Nov. 26, 2020

(30) Foreign Application Priority Data

May 21, 2019 (FR) ..... 1905345
Nov. 14, 2019 (FR) ..... 1912697

(51) Int. Cl.
*B65D 55/16* (2006.01)
*B65D 41/34* (2006.01)

(52) U.S. Cl.
CPC ..... *B65D 55/16* (2013.01); *B65D 41/3447* (2013.01)

(58) Field of Classification Search
CPC ..... B65D 55/16; B65D 55/024; B65D 41/3447; B65D 41/325; B65D 41/465;
(Continued)

(56) References Cited

U.S. PATENT DOCUMENTS 4,487,324 A * 12/1984 Ostrowsky ..... B65D 47/0814 215/253
4,513,870 A * 4/1985 Zaltsman ..... B65D 39/0017 215/253

(Continued)

FOREIGN PATENT DOCUMENTS

EP 1902972 A1 3/2008
JP 2014031202 A 2/2014

OTHER PUBLICATIONS

Rapport de Recherche Préliminaire dated Apr. 14, 2020, issued in priority French Application No. 1912697, filed Nov. 14, 2019, 2 pages.

(Continued)

*Primary Examiner* — Chun Hoi Cheung
*Assistant Examiner* — Brijesh V. Patel
(74) *Attorney, Agent, or Firm* — Christensen O'Connor Johnson Kindness PLLC

(57) ABSTRACT

A screw cap intended to remain attached to a container after opening the container. The cap includes a cylindrical wall having an inner surface including a thread arranged to engage with a thread arranged on a neck of the container, a safety ring extending the cylindrical wall and connected to the cylindrical wall by at least one fracturable connection. A portion of the cylindrical wall forms a strip connected to the safety ring by way of a connecting element arranged to make it possible to displace the cylindrical wall during the unscrewing of the cylindrical wall.

14 Claims, 6 Drawing Sheets

(58) Field of Classification Search
CPC ..... B65D 47/0804; B65D 2251/1008; B65D 2401/30; B65D 2401/20
USPC ..... 215/217, 252–253, 258, 306; 220/263, 220/283, 375, 810, 836–837, 843, 845, 220/847
See application file for complete search history.

(56) References Cited

U.S. PATENT DOCUMENTS 5,215,204 A * 6/1993 Beck ..... B65D 55/16 215/258
5,605,240 A * 2/1997 Guglielmini ..... B65D 41/485 215/256
6,041,477 A * 3/2000 Rentsch ..... E05D 1/02 16/225
6,419,101 B1 * 7/2002 Hessel ..... B65D 47/141 222/541.6
6,474,491 B1 * 11/2002 Benoit-Gonin .... B65D 41/3428 215/252
6,481,588 B1 * 11/2002 Wagner ..... B65D 41/485 215/235
6,971,531 B1 * 12/2005 Dubach ..... B65D 47/0861 220/827
7,731,042 B2 * 6/2010 Blomdahl ..... B65D 47/0809 220/254.5
8,469,213 B2 * 6/2013 Ishii ..... B65D 41/325 215/252
8,794,460 B2 * 8/2014 Druitt ..... B65D 47/0809 215/235
9,415,909 B2 * 8/2016 Druitt ..... B65D 47/0809
2006/0163188 A1 * 7/2006 Lagler ..... B65D 47/0809 215/235
2008/0011704 A1 * 1/2008 Van Ryn ..... B65D 47/0814 215/235
2011/0000871 A1 * 1/2011 Bernard ..... B65D 55/16 215/235
2011/0174760 A1 * 7/2011 Luzzato ..... B65D 41/48 215/252
2011/0297682 A1 * 12/2011 Kwon ..... B65D 51/16 220/268
2012/0024815 A1 * 2/2012 Kwon ..... B65D 55/16 215/272
2012/0285921 A1 * 11/2012 Kwon ..... B65D 41/3447 215/243
2012/0298666 A1 * 11/2012 Kwon ..... B65D 55/16 220/268
2013/0001185 A1 * 1/2013 Antier ..... B65D 41/3442 215/252
2016/0288961 A1 * 10/2016 Maguire ..... B65D 41/34
2018/0162605 A1 * 6/2018 Zeng ..... B65D 41/34
2018/0170625 A1 * 6/2018 Sung ..... B65D 55/16

OTHER PUBLICATIONS

Rapport de Recherche Préliminaire dated Mar. 11, 2020, issued in priority French Application No. 1905345, filed May 21, 2019, 2 pages.

* cited by examiner

SCREW CAP INTENDED TO REMAIN ATTACHED TO A CONTAINER AFTER OPENING THE CONTAINER

TECHNICAL FIELD

Embodiments of the present disclosure relate to a screw cap intended to be mounted by screwing to seal (or close) the neck of a container and to remain attached to the container after opening the neck.

BACKGROUND

For environmental reasons, in most countries, new regulations require or will require that the cap of a container, such as a bottle, remains attached to the container, even when the cap leaves the neck of the container open.

A friction cap intended to be attached to its container after opening the neck of the container is already known. These friction caps are intended to close a container by remaining connected to the neck of the container by the effect of friction or by snap-fitting between the cap and the neck of the container. However, this friction cap does not have the advantages of a screw cap, the latter making it possible to close the neck of a container safely.

Furthermore, most containers are closed with a screw cap. Consequently, to conform with the new regulations, the bottling lines which are configured to assemble screw caps on their containers require a sometimes complex and expensive adaptation to adapt the bottling line to these friction caps.

SUMMARY

The present disclosure aims to overcome these disadvantages, or others, by providing a screw cap intended to remain attached to the container and that does not need any adaptation of assembly lines.

To this end, the disclosure relates to a screw cap intended to remain attached to a container after opening the container.

In an embodiment, the cap comprises:

- a cylindrical wall having a longitudinal axis, a first end closed by a bottom and a second open end, the cylindrical wall having an inner surface including a thread arranged to engage with a thread arranged on a neck of the container, the cylindrical wall being configured to be located alternatively in a closed position, wherein the cylindrical wall is screwed on the neck, and an open position, wherein the cylindrical wall is unscrewed from the neck and the neck is open,
- a safety ring extending the cylindrical wall and intended to be retained at the neck by a retaining element arranged on the container, the safety ring being connected to the second end of the cylindrical wall by at least one fracturable connection, the fracturable connection being arranged to be fractured during a first unscrewing of the cylindrical wall.

According to the disclosure, a portion of the cylindrical wall forms a first strip extending between a first tip and a second tip parallel with the longitudinal axis, the first tip being connected to the cylindrical wall by a first hinge, the second tip being connected to the safety ring by way of a connecting element, the connecting element being arranged to make it possible for the displacement of the cylindrical wall along the longitudinal axis during an unscrewing of the cylindrical wall.

Thus, due to the first strip and to the connecting element, the screw cap remains attached to its container after opening the container. The connecting element enables the translation of the cylindrical wall during unscrewing and the first strip allows for articulation of the cylindrical wall with respect to the container. In addition, due to the cap, it is not necessary to carry out significant modifications of the bottling lines intended to assemble screw caps that do not remain attached to the container thereof.

Furthermore, the first strip in some embodiments has longitudinal edges parallel with the longitudinal axis, each of the longitudinal edges being connected respectively to the cylindrical wall by a tearable line, each tearable line being arranged to be torn after the first unscrewing of the cylindrical wall and a first opening of the neck of the container.

In addition, the connecting element in some embodiments comprises two arms, each of the arms having a first end and a second end, the arms being joined to one another at the first end and being deviated symmetrically on either side of the first strip towards the second end, the second end being connected to the safety ring.

According to an embodiment, the connecting element further comprises a second hinge connecting the second tip of the first strip to the arms.

Moreover, the second end of the cylindrical wall comprises an edge portion having a first indentation, the arms being housed in the first indentation by completing the edge of the second end of the cylindrical wall on the first indentation, the fracturable connection connects the safety ring, on the one hand, to the second end of the cylindrical wall and, on the other hand, to the arms, the second end of each of the arms having a portion being deviated from the first indentation to connect the safety ring.

Advantageously, each tearable line also connects each of the arms to the cylindrical wall.

According to an embodiment, the safety ring comprises at least one support element arranged such that the safety ring facing the arms can rest against the arms during a forced movement of the safety ring over the retaining element to assemble the cap on the container.

According to an embodiment, the cap further comprises a second strip extending the first strip and arranged in the same plane as the first strip, the second strip being separated from the first strip by the connecting element, the safety ring having a cut-out adapted to house the second strip, the second strip being adapted to prevent the rotation of the cap about the longitudinal axis when the cylindrical wall is located in the open position, the rotation of the cap about the longitudinal axis being prevented by the pressure of the second strip caused by the tilting of the plane including the first strip and the second strip around the connecting element when the cylindrical wall is brought into the open position.

According to another embodiment, the cap comprises a third strip extending the first strip and arranged substantially in the same common plane as the first strip, the safety ring having a cut-out adapted to house the third strip, the third strip comprising at least one abutment projecting over the third strip outwards from the cylindrical wall, the abutment(s) being arranged to rest against a shoulder arranged on the container after a tilting of the common plane when the cylindrical wall is brought into a blocking configuration of the cap, the two arms of the connecting element being configured to bring the common plane towards the safety ring after the tilting until the abutment(s) rest against the shoulder, the blocking configuration corresponding to a configuration of the open position of the cylindrical wall, wherein the circular wall is prevented from returning into the closed position.

According to an embodiment, the abutment(s) has/have an extended shape having a first portion and a second portion, the first portion being configured to abut against the shoulder when the cylindrical wall is located in the blocking configuration, the second portion having a shape facilitating a passage towards the blocking configuration when the cylindrical wall is in the open position.

Furthermore, the cap in some embodiments comprises an inner capping cylindrical skirt carried by the bottom and configured to penetrate into the neck of the container during the screwing of the cylindrical wall towards the closed position.

In addition, the cylindrical skirt in some embodiments comprises a free edge having a second indentation facing the first strip.

Advantageously, the cylindrical wall may have an outer surface that features a grip.

In some embodiments, the safety ring comprises an outer circular portion and an inner circular portion, the outer circular portion extending the cylindrical wall, the inner circular portion being inverted with respect to the outer circular portion inside the safety ring, the safety ring being intended to be retained at the neck by the engagement of the inner circular portion with the retaining element.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

Figure 1:
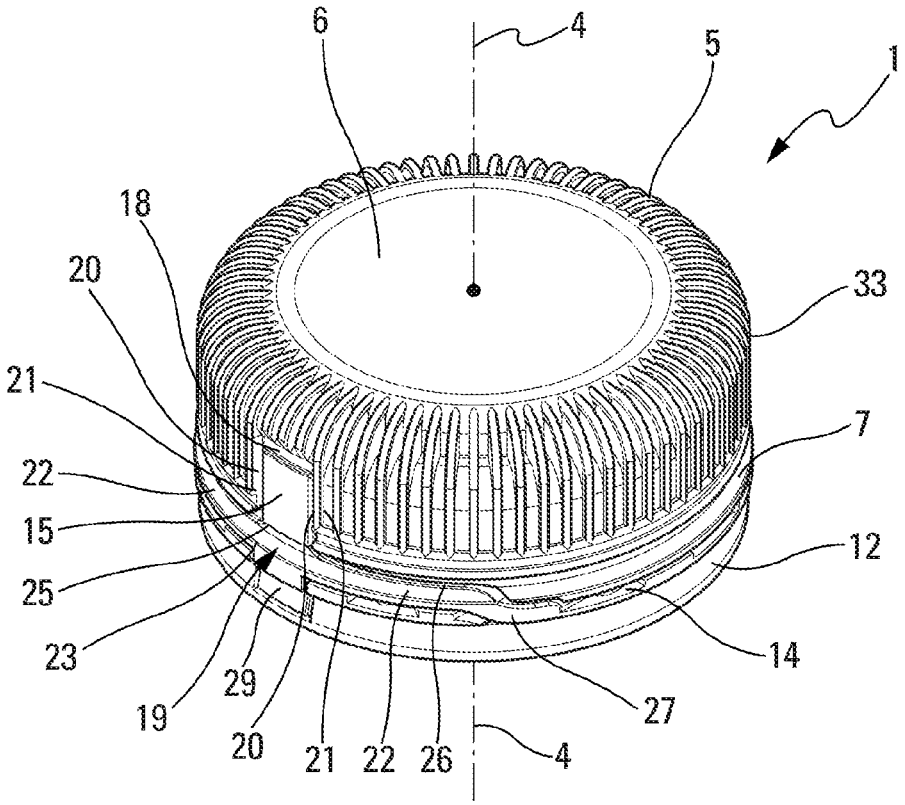
FIG. 1 shows a top, perspective view of the cap according to a first embodiment.
Figure 2:
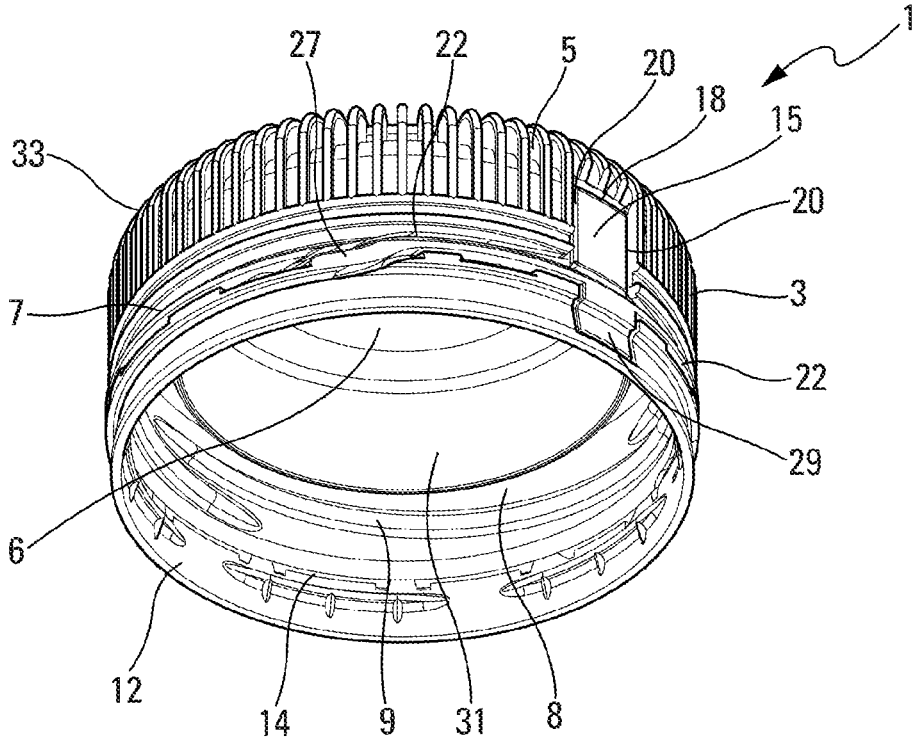
FIG. 2 shows a bottom, perspective view of the cap according to a first embodiment.
Figure 9:
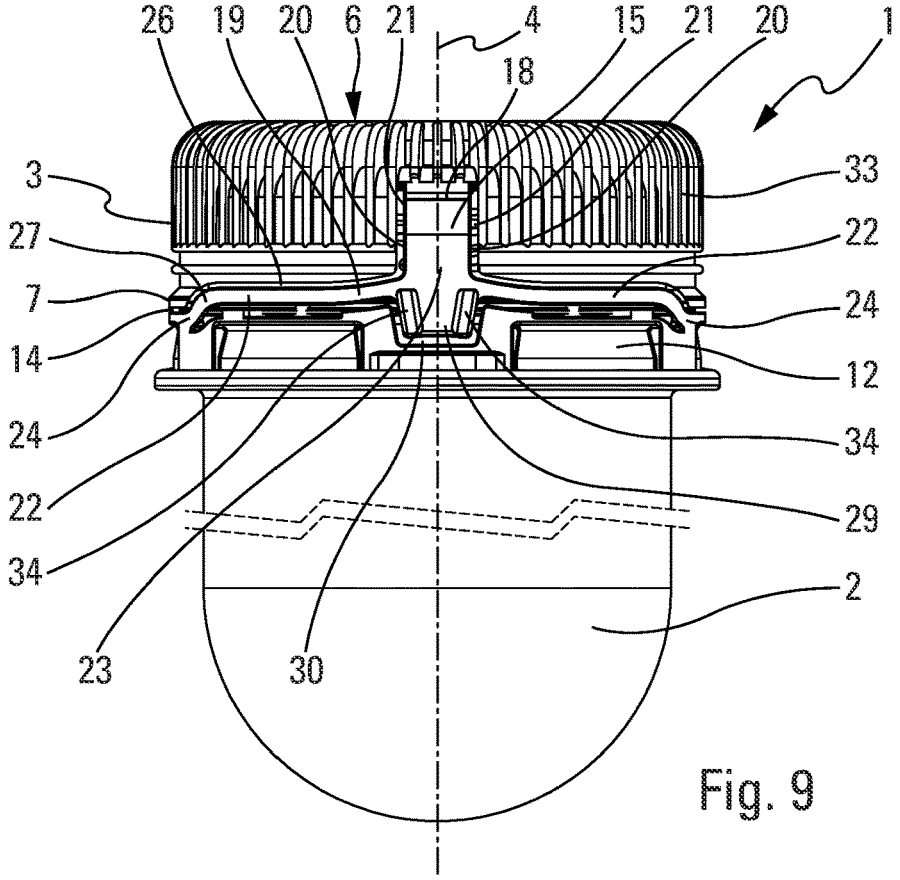
FIG. 9 shows a front view of the cap according to a second embodiment.

FIG. 1 shows a view of a first embodiment of the screw cap 1 intended to or otherwise configured to remain attached to a container 2, in particular a bottle, after opening the container 2. FIG. 9 shows a view of a second embodiment of the screw cap 1 intended to or otherwise configured to remain attached to a container 2.

In a non-limiting manner, the cap 1 is made of plastic material using an injection moulding technology. For example, the plastic material can be high-density polyethylene (HDPE) or polypropylene (PP).

Figure 8:
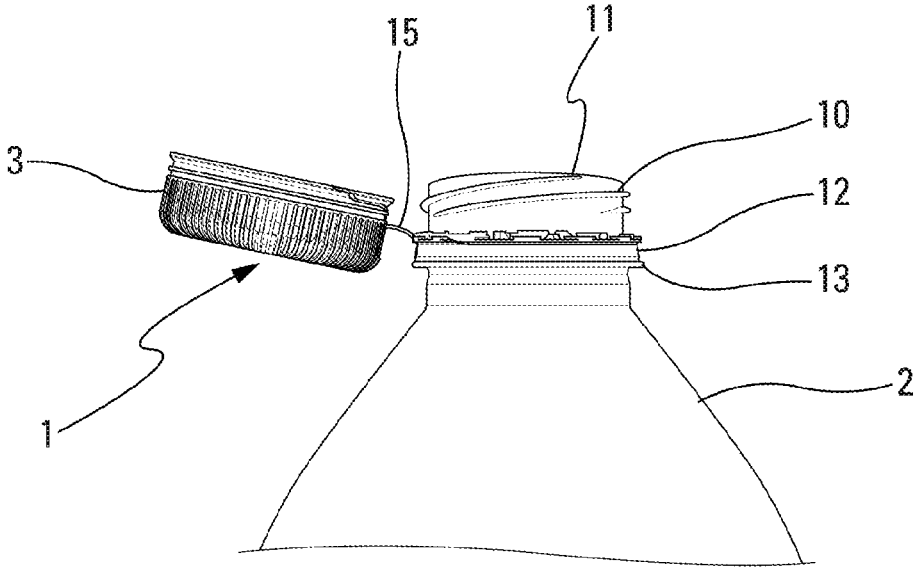
FIG. 8 shows a container and the cap according to a first embodiment in the open position.

As shown in FIG. 1, the cap 1 comprises a cylindrical wall 3 having a longitudinal axis 4. The cylindrical wall 3 has a cylinder of revolution shape. The longitudinal axis 4 is combined with the cylinder axis. The cylindrical wall 3 includes an end 5 closed by a bottom 6 and an open end 7. The cylindrical wall 3 has an inner surface 8 including a thread 9 arranged to engage with a thread 10 arranged on a neck 11 of the container 2 (FIGS. 4, 7, 11 and 12). The cylindrical wall 3 is configured to be located alternatively in a closed position (FIGS. 7 and 11), wherein the cylindrical wall 3 is screwed on the neck 11, and an open position (FIGS. 8 and 12), wherein the cylindrical wall 3 is unscrewed from the neck 11 and the neck 11 is open.

Figure 4:
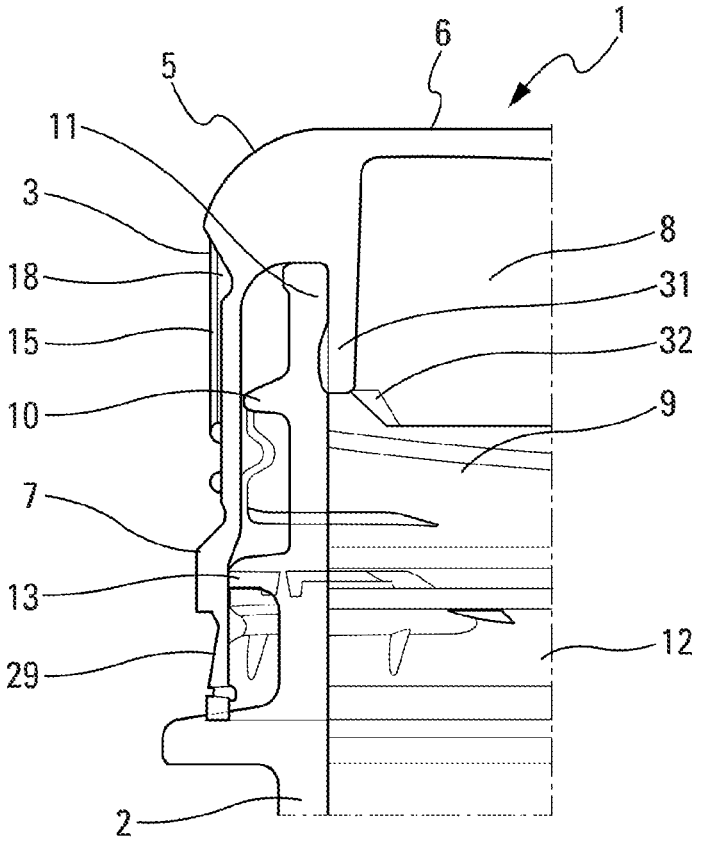
FIG. 4 shows a cross-section A-A of the cap of FIG. 3.
Figure 5:
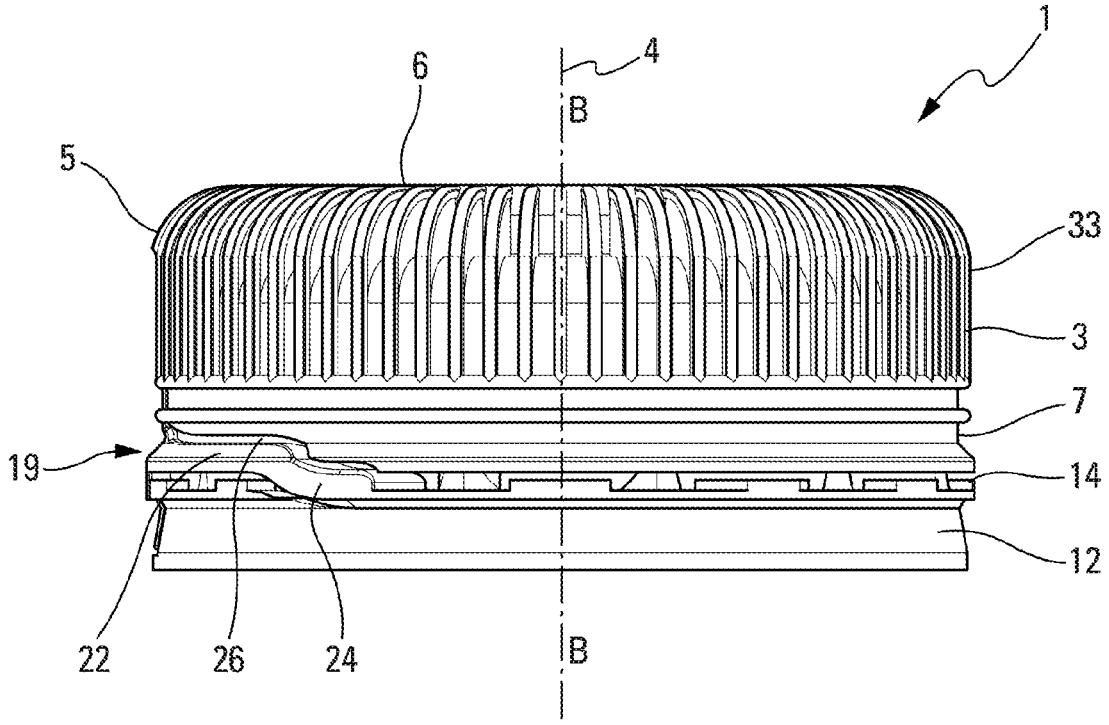
FIG. 5 shows a profile view of the cap according to a first embodiment.
Figure 11:
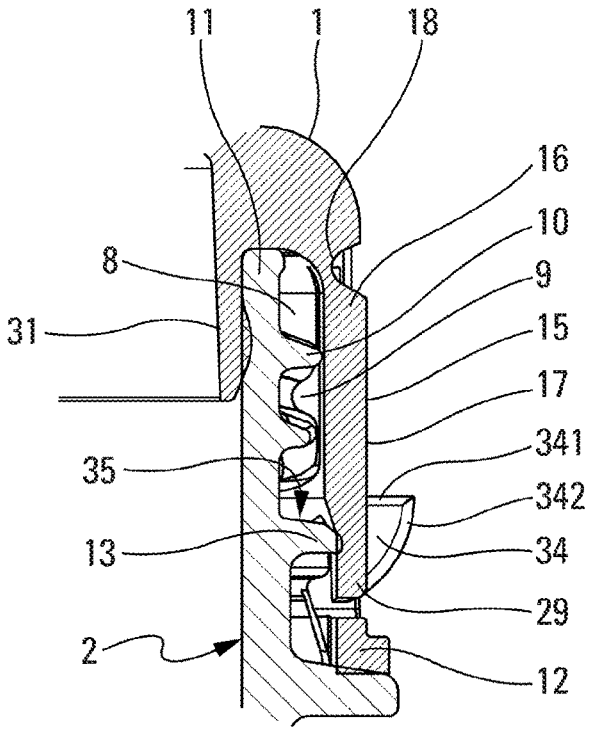
FIG. 11 shows a detailed cross-section of the cap according to a second embodiment in the closed position.

In the embodiment shown, the cap 1 further comprises a safety ring 12 extending the cylindrical wall 3. The safety ring 12 is intended to be retained at the neck 11 by a retaining element 13 arranged on the container 2 (FIGS. 4 and 11). The retaining element 13 can be a circular projection or at least one circular projecting portion arranged on the neck 11 of the container 2.

The safety ring 12 is connected to the end 7 of the cylindrical wall 3 by at least one fracturable connection 14. The fracturable connection 14 is arranged to be fractured during a first unscrewing of the cylindrical wall 3.

A portion of the cylindrical wall 3 forms a first strip 15 which extends between a first tip 16 and a second tip 17 parallel with the longitudinal axis 4. The first tip 16 is connected to the cylindrical wall 3 by a hinge 18. The hinge 18 can correspond to a thinning of the thickness of the cylindrical wall 3 connecting the first strip 15. This thinning of thickness makes it possible for the first strip 15 to be articulated with the cylindrical wall 3 at the thinning.

The second tip 17 is connected to the safety ring 12 by way of a connecting element 19. The connecting element 19 is arranged to make it possible for the displacement (in translation) of the cylindrical wall 3 along the longitudinal axis 4 during unscrewing of the cylindrical wall 3.

The first strip 15 has longitudinal edges 20 parallel with the longitudinal axis 4. Each of the longitudinal edges 20 can be connected respectively to the cylindrical wall 3 by a tearable line 21. Each tearable line 21 is arranged to be torn after the first unscrewing of the cylindrical wall 3 and a first opening of the neck 11 of the container 2. Thus, each tearable line 21 can correspond to a pre-cut-out line which is torn when the cylindrical wall 3 is cleared from the neck 11 of the container 2 then tilted with respect to the first strip 15, after the first unscrewing of the cylindrical wall 3.

Moreover, the connecting element 19 can comprise two arms 22. Each of the arms has a first end 23 and a second end 24. The arms 22 are joined to one another at the first end 23 and are deviated symmetrically on either side of the first strip 15 towards the second end 24. The second end 24 is connected to the safety ring 12.

Each of the arms is sized to provide flexibility making it possible for the cylindrical wall 3 to be displaced in translation along the longitudinal axis 4 during the unscrewing of the cylindrical wall 3 until the cylindrical wall is completely unscrewed. The first strip 15 and the connecting element 19 thus hold the cylindrical wall 3 to the safety ring 12 which is retained on the neck 11 of the container 2. Moreover, the arms are sized to resist a maximum traction force, sufficient to prevent the cylindrical wall 3 from being ripped off the container. The traction force can be defined according to normal use of the cap. The maximum traction force can be defined according to standards determined for the opening of a cap 1. In a non-limiting manner, the arms 22 are sized such that the maximum traction force is substantially equal to 35N.

According to a first embodiment, the connecting element 19 further comprises a second hinge 25 connecting the second tip 17 of the first strip 15 to the arms 22 (at the first end 23 of each arm).

The second end 7 of the cylindrical wall 3 can comprise an edge portion having an indentation 26. The arms 22 are housed in the indentation 26. The arms 22 complete the edge of the end 7 of the cylindrical wall 3 on the indentation 26. The arms 22 thus fill the space left by the indentation 26.

The indentation 26 can have a shape making it possible to facilitate screwing of the cylindrical wall 3 by avoiding contact between the thread 9 and the neck 11 of the container 2. For example, the spacing between the edge of the indentation 26 and the arms 22 expands progressively from the second end 24 to the first end 23.

Moreover, the fracturable connection 14 can connect the safety ring 12 to the end 7 of the cylindrical wall 3. The fracturable connection 14 connects the safety ring 12 to the arms 22. The end 7 of each arm 22 can have a portion 27 deviated from the indentation 26 to connect the safety ring 12.

Advantageously, each tearable line 21 also connects each of the arms 22 to the cylindrical wall 3. Thus, the tearable line 21 connecting each of the longitudinal edges 20 to the cylindrical wall 3 extends to connect each of the arms 22 to the cylindrical wall 3. The tearable line 21 between each of the arms 22 and the cylindrical wall 3 provides for an improved seal of the cap 1 when the cylindrical wall 3 is in the closed position before the first unscrewing of the cylindrical wall 3.

Figure 3:
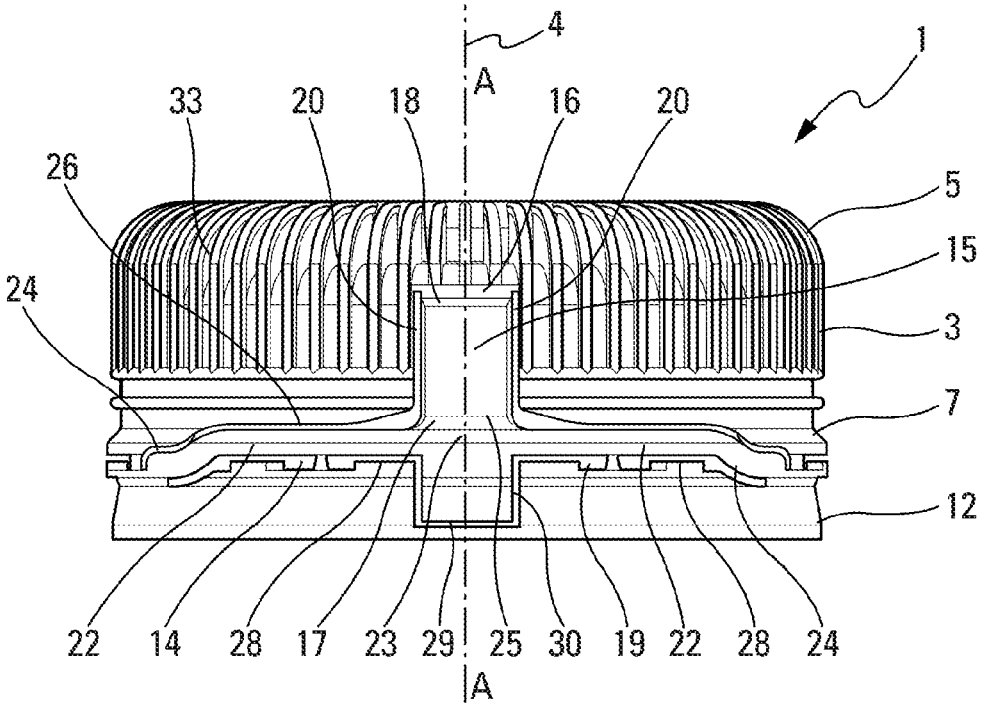
FIG. 3 shows a front view of the cap according to a first embodiment.
Figure 6:
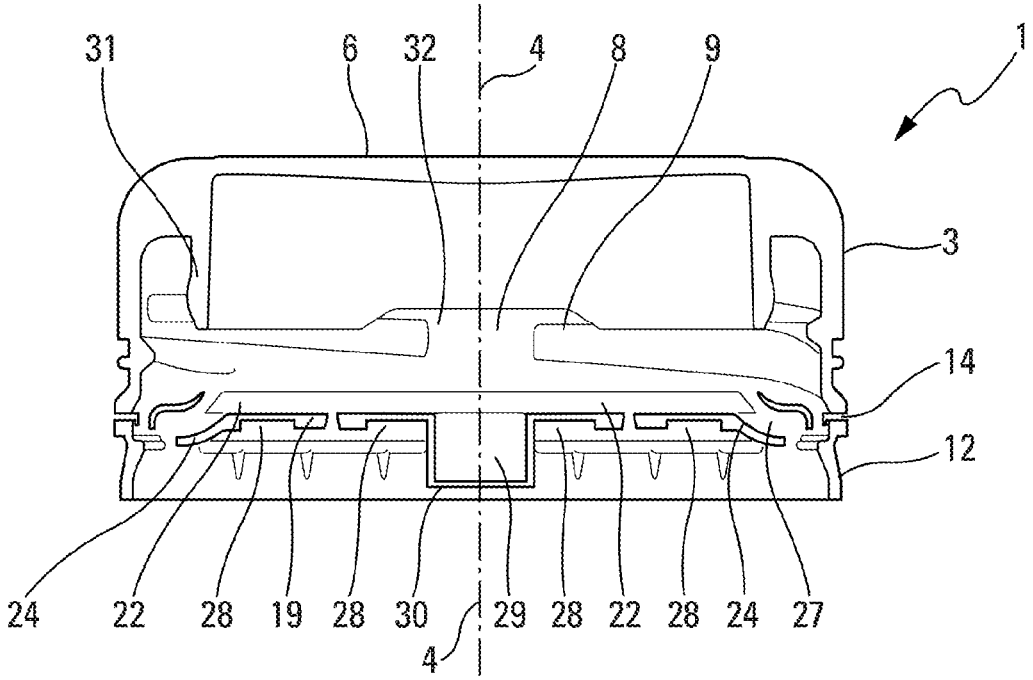
FIG. 6 shows a cross-section B-B of the cap of FIG. 5.
Figure 7:
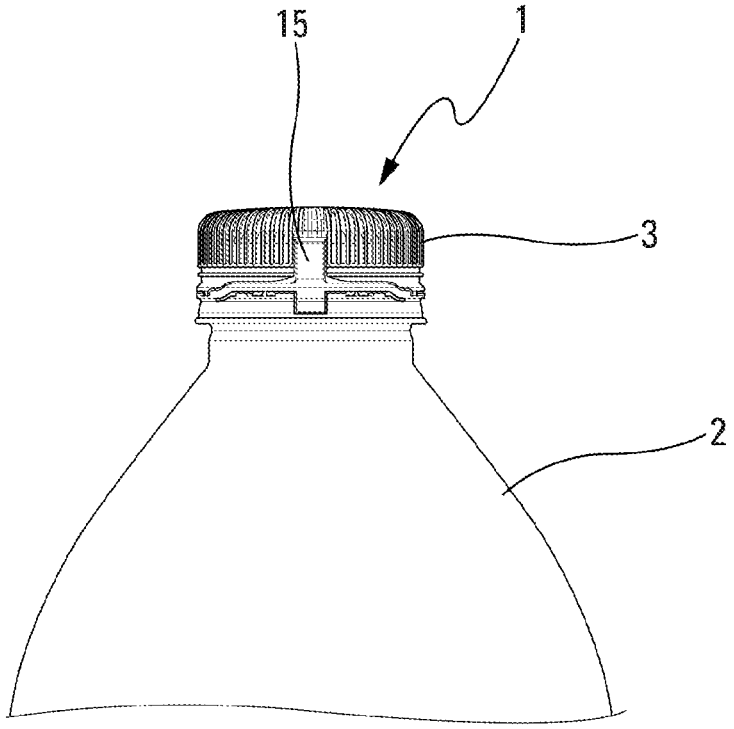
FIG. 7 shows a container and the cap according to a first embodiment in the closed position.

The safety ring 12 can comprise at least one support element 28. This or these support elements 28 are arranged such that the safety ring 12 facing the arms 22 can rest against the arms 22 during a forced movement of the safety ring 12 over the retaining element 13 to assemble the cap 1 on the container 2 on a bottling line. FIGS. 3 and 6 show four support elements 28 distributed over the safety ring 12 facing the arms 22. The support element(s) 28 can correspond to one or more projections with a substantially parallelepiped shape forming a single part with the safety ring 12.

According to the first embodiment, the cap 1 can also comprise a second strip 29 extending the first strip 15 and arranged substantially in the same plane as the first strip 15. The second strip 29 is separated from the first strip 15 by the connecting element 19. The safety ring 12 has a cut-out 30 adapted to house the second strip 29. The second strip 29 is adapted to prevent the rotation of the cap 1 about the longitudinal axis 4 when the cylindrical wall 3 is located in the open position. The rotation of the cap 1 about the longitudinal axis 4 is prevented by the friction forces caused by the pressure of the second strip 29 against the container 2 of the second strip 29. The pressure of the second strip 29 against the container 2 is a consequence of the tilting of the plane including the first strip 15 and the second strip 29 around the connecting element 19 when the cylindrical wall 3 is brought into the open position.

Figure 10:
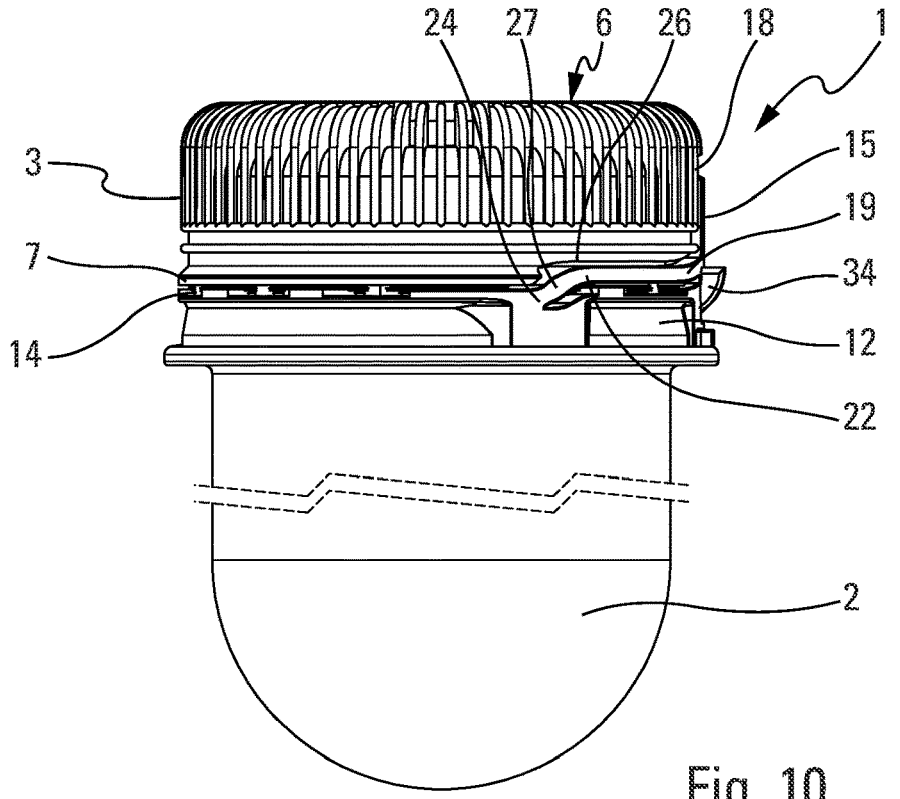
FIG. 10 shows a side view of the cap according to a second embodiment.

According to the second embodiment, the cap 1 also comprises a second strip 29 extending the first strip 15 and arranged substantially in the same common plane as the first strip 15 (FIGS. 9 and 10). The safety ring 12 also has a cut-out 30 adapted to house the second strip 29. The second strip 29 comprises at least one abutment 34 projecting over the second strip 29 outwards from the cylindrical wall 3.

Figure 12:
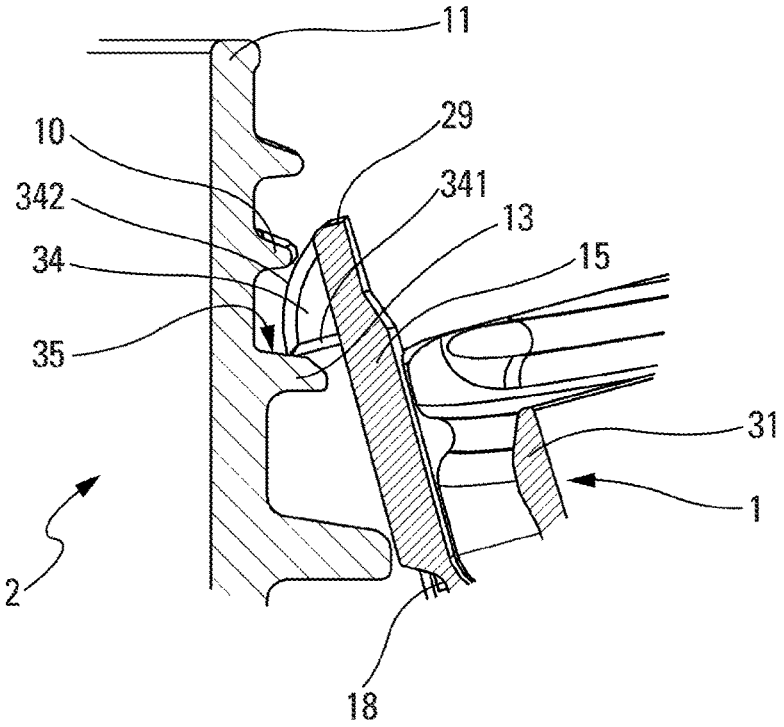
FIG. 12 shows a detailed cross-section of the cap according to a second embodiment in the open position and in the blocking configuration.

The abutment(s) 34 is/are arranged to rest against a shoulder 35 arranged on the container 2 after a tilting of the common plane when the cylindrical wall 3 is brought into a blocking configuration of the cap 1 (FIG. 12). The blocking configuration represented in FIG. 12 corresponds to a configuration of the open position of the cylindrical wall 3, in which the circular wall 3 is prevented from returning into the closed position.

The two arms 22 of the connecting element 19 are configured to bring the common plane towards the safety ring 12 after the tilting of the element until the abutment(s) 34 rest against the shoulder 35.

The shoulder 35 can correspond at least partially to the retaining element 13 retaining the safety ring 12 on the neck 11 of the container 2.

Advantageously, the abutment(s) 34 has/have an extended or gadroon shape projecting over the second strip 29. The extended shape has, in a direction going towards the free end of the second strip 29, a first portion 341 and a second portion 342 (FIGS. 11 and 12). The first portion 341 is configured to abut against the shoulder 35 when the cylindrical wall 3 is located in the blocking configuration. The second portion 342 has a shape facilitating a passage towards the blocking configuration when the cylindrical wall 3 is in the open position.

Thus, this or these abutments 34 form a hard point around which the tilting is achieved, in order to pass towards the blocking configuration.

In a non-limiting manner, the first portion 341 has a straight shape, substantially perpendicular to the second strip 29. The straight shape has a first end situated on the upper surface of the second strip 29 directed outwards from the cylindrical wall 3 and a second free end. The second portion 342 has a rounded shape. The rounded shape joins the upper surface of the second strip 29 and the second free end of the first portion 341.

Thus, when the cylindrical wall is in the open position, the passage towards the blocking configuration is done by the sliding of the shoulder 35 against the second portion 342. The rounded shape of the second portion 342 facilitates the sliding. This sliding leads acts on the hinge 18 by the alignment of the free end of the second strip 29 inwards from the cap 1. As soon as the shoulder 35 reaches the second free end of the portion 341, the free end of the second strip 29 is extended from inside the cap 1 thanks to the elasticity of the hinge 18. The two arms 22 thus make it possible for the first portion 341 to rest against the shoulder 35.

Advantageously, the extended shape of the abutment(s) 34 has a longitudinal axis forming a non-zero angle with the longitudinal axis 4. FIG. 9 shows two abutments 34, of which the extended shapes are symmetrically deviated as the hinge 18 is approached by a non-zero angle with respect to the longitudinal axis 4.

The cap 1 can further comprise an inner capping cylindrical skirt 31 carried by the bottom 6 and configured to penetrate into the neck 11 of the container 2 during the screwing of the cylindrical wall 3 towards the closed position.

In an embodiment, the cylindrical skirt 31 has a longitudinal axis or cylindrical axis that coincides with the longitudinal axis 4 of the cylindrical wall 3.

Between the cylindrical skirt 31 and the cylindrical wall 3, the bottom 6 of the cap 1 is arranged such that the free end of the neck 11 abuts against the bottom 6 of the cap 1 when the cylindrical wall is in the closed position.

For example, the portion of the bottom 6 with a location corresponding to that of the cylindrical skirt 31 is externally elevated to increase the outer surface area of the cap 1. The cavity delimited by the cylindrical skirt 31 and the cavity caused by the outer elevation of the bottom 6 being combined to form a large single cavity with a smooth wall. A circular recess is formed between the elevated portion and the non-elevated portion of the bottom 6. The free end of the neck 11 of the container abuts against the non-elevated portion of the bottom 6, when the cylindrical wall is in the closed position. This makes it possible to ensure a tight seal of the cap 1.

The first tip 16 connecting the first strip 15 to the cylindrical wall 3 can be at a height less than or equal to a height at the level of the bottom 6 of the cap 1 against which the free end of the neck 11 of the container 2 abuts, when the cylindrical wall 3 is in the closed position.

Advantageously, the cylindrical skirt 31 comprises a free edge having an indentation 32 facing the first strip 15. This indentation 32 makes it possible to facilitate clearing of the cylindrical wall 3 of the neck 11 of the container 2 after the unscrewing thereof. It also makes it possible to facilitate the fitting of the cylindrical wall 3 on the neck 11 of the container 2 before the screwing of the cylindrical wall 3 on the neck 11.

The cylindrical wall 3 can have an outer surface that features a grip 33. In a non-limiting manner, the gripping surface corresponds to diametrical fins regularly distributed over the outer surface of the cylindrical wall 3.

According to an embodiment, the safety ring 12 comprises an outer circular portion and an inner circular portion. The outer circular portion extends the cylindrical wall 3. The inner circular portion is inverted with respect to the outer circular portion inside the safety ring 12. The safety ring 12 is thus intended to be retained at the neck 11 by engagement of the inner circular portion with the retaining element 13.

The cap can be used for any container 2 having a screw neck 11. The cap 1 can also have a diameter adapted to any screw container neck 11. The diameter of the cap 1 can therefore be equal to any diameter making it usable with any screw neck 11 diameter of a container 2.

Moreover, the cap 1 can be used for a container 2 that could contain any type of liquid or drink. In a non-limiting manner, the container 2 can be a container 2 that could contain a flat liquid, a gaseous liquid, a fruit juice, milk, etc. The different portions of the cap 1, such as the cylindrical wall 3, the bottom 6, the cylindrical skirt 31, the thread 9 can be sized according to the liquid or the drink intended to be contained in the container 2. For example, these different portions can be more or less thick. Likewise, the thread 9 can have more or less tight and/or more or less coarse thread. Likewise, the threads of the thread 9 can have interruptions according to the liquid or the drink intended to be contained in the container 2.

The present application may reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrase "at least one of A and B" is equivalent to "A and/or B" or vice versa, namely "A" alone, "B" alone or "A and B.". Similarly, the phrase "at least one of A, B, and C," for example, means (A), (B), (C), (A and B), (A and C), (B and C), or (A, B, and C), including all further possible permutations when greater than three elements are listed.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A screw cap for remaining attached to a container after opening the container, the cap comprising:

a cylindrical wall having a longitudinal axis, a first end closed by a bottom and a second open end, the cylindrical wall having an inner surface including a thread arranged to be engageable with a thread arranged on a neck of the container, the cylindrical wall being configured to be located alternatively in a closed position, wherein the cylindrical wall is screwed on the neck, and an open position, wherein the cylindrical wall is unscrewed from the neck and the neck is open; and a safety ring extending the cylindrical wall and intended to be retained at the neck by a retaining element arranged on the container, the safety ring being connected to the second open end of the cylindrical wall by at least one fracturable connection, the at least one fracturable connection being arranged to be fractured during a first unscrewing of the cylindrical wall, wherein a portion of the cylindrical wall forms a first strip extending between a first tip and a second tip parallel with the longitudinal axis, the first tip being connected to the cylindrical wall by a first hinge corresponding to a thinning of the thickness of the cylindrical wall connecting the first strip, the second tip being connected to the safety ring by a connecting element, the connecting element being arranged to provide displacement of the cylindrical wall along the longitudinal axis during an unscrewing of the cylindrical wall, wherein the first strip further has longitudinal edges parallel with the longitudinal axis, each of the longitudinal edges being connected respectively to the cylindrical wall by a tearable line, each tearable line being arranged to be torn during a first locating of the cylindrical wall to the open position.

2. The cap according to claim 1, wherein the connecting element comprises two arms, each of the arms having a first end and a second end, the arms being joined to one another at the first end and being symmetrically deviated on either side of the first strip towards the second end, the second end being connected to the safety ring.

3. The cap according to claim 2, wherein the connecting element further comprises a second hinge connecting the second tip of the first strip to the arms.

4. The cap according to claim 2, wherein the second open end of the cylindrical wall comprises an edge portion having a first indentation, the arms being housed in the first indentation by completing the edge of the second open end of the cylindrical wall on the first indentation, and wherein the at least one fracturable connection connects the safety ring, on the one hand, to the second open end of the cylindrical wall and, on the other hand, to the arms, the second end of each of the arms having a portion being deviated from the first indentation to connect the safety ring.

5. The cap according to claim 2, wherein each tearable line also connects each of the arms to the cylindrical wall.

6. The cap according to claim 2, wherein the safety ring comprises at least one support element arranged such that the safety ring facing the arms rests against the arms during forced movement of the safety ring over the retaining element to assemble the cap on the container.

7. The cap according to claim 1, wherein the cap further comprises a second strip extending the first strip and arranged in the same plane as the first strip, the second strip being separated from the first strip by the connecting element, the safety ring having a cut-out adapted to house the second strip, the second strip being adapted to prevent the rotation of the cap about the longitudinal axis when the cylindrical wall is located in the open position, the rotation of the cap about the longitudinal axis being prevented by the pressure of the second strip caused by the tilting of the plane including the first strip and the second strip around the connecting element when the cylindrical wall is brought into the open position.

8. The cap according to claim 1, wherein the cap comprises a third strip extending the first strip and arranged in the same common plane as the first strip, the safety ring having a cut-out adapted to house the third strip, the third strip comprising at least one abutment projecting over the third strip outwards from the cylindrical wall, the at least one abutment being arranged to rest against a shoulder arranged on the container after a tilting of the common plane when the cylindrical wall is brought into a blocking configuration of the cap, the two arms of the connecting element being configured to bring the common plane towards the safety ring after the tilting until the at least one abutment rest against the shoulder, the blocking configuration corresponding to a configuration of the open position of the cylindrical wall, wherein the circular wall is prevented from returning into the closed position.

9. The cap according to claim 8, wherein the at least one abutment has an extended shape having a first portion and a second portion, the first portion being configured to abut against the shoulder when the cylindrical wall is located in the blocking configuration, the second portion having a shape facilitating a passage towards the blocking configuration when the cylindrical wall is in the open position.

10. The cap according to claim 1, wherein the cap further comprises an inner capping cylindrical skirt carried by the bottom and configured to penetrate into the neck of the container during screwing of the cylindrical wall towards the closed position.

11. The cap according to claim 10, wherein the cylindrical skirt comprises a free edge having a second indentation facing the first strip.

12. The cap according to claim 1, wherein the cylindrical wall has an outer surface that features a grip.

13. The cap according to claim 12, wherein the first hinge is positioned on the outer surface circumferentially adjacent to the grip.

14. The cap according to claim 1, wherein the safety ring comprises an outer circular portion and an inner circular portion, the outer circular portion extending the cylindrical wall, the inner circular portion being inverted with respect to the outer circular portion inside the safety ring, the safety ring being intended to be retained at the neck by the engagement of the inner circular portion with the retaining element.

* * * * *